United States Patent [19]

Michaels et al.

[11] Patent Number: 4,857,007

[45] Date of Patent: Aug. 15, 1989

[54] MOLDED ENVIRONMENTAL SEAL FOR ELECTRICAL CONNECTION

[75] Inventors: Leonard H. Michaels, Warrenville; Robert A. Miller, Woodridge, both of Ill.

[73] Assignee: Molex Incorporated, Lisle, Ill.

[21] Appl. No.: 214,073

[22] Filed: Jul. 1, 1988

[51] Int. Cl.[4] ..... H01R 13/52

[52] U.S. Cl. ..... 439/283; 439/273; 439/905; 439/589

[58] Field of Search ..... 439/548, 559, 271–283, 439/587, 589, 905

[56] References Cited

U.S. PATENT DOCUMENTS

| | | | |
|---|---|---|---|
| 4,335,928 | 6/1982 | Barrett et al. | 439/271 |
| 4,676,573 | 6/1987 | Norman | 439/277 |
| 4,707,047 | 11/1987 | Michaels et al. | 439/271 |

FOREIGN PATENT DOCUMENTS

| | | | |
|---|---|---|---|
| 1196402 | 11/1985 | Canada | 439/271 |
| 1027727 | 5/1953 | France | 439/271 |
| 1314138 | 11/1962 | France | 439/271 |

*Primary Examiner*—David Pirlot

*Attorney, Agent, or Firm*—Louis A. Hecht; Stephen Z. Weiss

[57] ABSTRACT

An electrical connector backshell and a molded environmental seal for use therewith are provided. The backshell includes an internal array of threads for mating with a frontshell. An internal cylindrical surface is provided rearwardly of the threads and terminates at an inwardly directed annular shoulder. The seal is molded from a unitary piece of elastomeric material and is dimensioned to be engaged within the internal cylindrical surface of the backshell. The seal is provided with a mating end for mounting against the shoulder of the backshell. The mating end of the seal is provided with an annular mounting flange for engaging the groove in the backshell. The forward mating end of the seal defines a radially outer annular locking ridge and a radially inner annular sealing ridge. The locking and sealing ridges are constructed for secure environmental sealing engagement with a plurality of different frontshell configurations.

1 Claim, 6 Drawing Sheets

MOLDED ENVIRONMENTAL SEAL FOR ELECTRICAL CONNECTION

BACKGROUND OF THE INVENTION

Electrical connectors used in uncontrolled environments typically are provided with seals to protect the electrically conductive members therein. For example, many electrical connectors are used in environments where ambient moisture, lubricants or other liquids could seep into portions of the connector at which terminals are disposed, thereby damaging these electrically conductive components or degrading the signals they carry. State-of-the-art military equipment often includes electrical connectors which necessarily are used in such uncontrolled environments.

One particular type of electrical connector includes a cable terminated in a connector which in turn is mateable with a connector mounted to a second cable or a panel of an electrical apparatus. The cable may comprise one or more conductors depending upon the particular application. The cable often will be used with a backshell/frontshell combination. For example, the entire cable may be securely mounted to a backshell, with appropriate strain relief and environmental sealing between the cable and the backshell. The backshell typically is formed from an electrically conductive material to ensure electrical grounding across the connector. The forward end of this prior art backshell typically is threadably connected to the rearward end of a frontshell, which in turn is removably mounted to a connector housing. The terminals to which the conductive leads of the cable are joined are appropriately mounted within the connector housing. The connector housing and the terminals therein may then be mated with a corresponding connector mounted to another cable or a panel of an electrical apparatus.

The configuration of the connector housing is dictated by the number and type of terminals to be mounted therein and by the configuration of the electrical apparatus to which the connector is mounted. The configuration of the frontshell is at least in part dictated by the configuration of the connector to which the frontshell is mounted. Many frontshells and their associated connector housings are manufactured to military specifications developed to meet particular military applications. However, many such frontshells and connector housings have been adopted by industries for nonmilitary applications.

The rearwardly facing end of the prior art frontshell has assumed many structural configurations depending upon the particular military specification that has been adopted and followed. For example, some frontshells have a circumferential array of rearwardly projecting serrations, while others have a substantially planar rearward face. Some frontshells have substantially narrow rearwardly facing walls, while others have substantially thick rearwardly facing walls. In all such applications, it is generally desirable to provide environmental sealing between the frontshell and backshell. In the past, the particular configuration of the environmental seal between the frontshell and the backshell has been dependent upon the configuration of the rearwardly facing end of the frontshell. This has created substantial inventory problems and has added to the total cost of the assembly.

The prior art includes a particularly effective seal for mounting in a backshell and for universal use with a plurality of different frontshell configurations. This seal is shown in U.S. Pat. No. 4,707,047 which issued to the applicants herein on Nov. 17, 1987 and which is assigned to the assignee of the subject invention. The disclosure of U.S. Pat. No. 4,707,047 is incorporated herein by reference. Briefly, the backshell shown in U.S. Pat. No. 4,707,047 includes a generally cylindrical rigid outer shell and a coupling portion comprising an array of internal threads adapted to engage external threads on a frontshell. The backshell further comprises a shoulder disposed radially and axially inwardly from the array of internal threads to generally face the frontshell to be mated therewith. The backshell shown in U.S. Pat. No. 4,707,047 further comprises a recess formed at a radial location between the shoulder and the exterior wall of the backshell. The recess extends in axial directions on either side of the shoulder mating surface. The backshell shown in U.S. Pat. No. 4,707,047 further comprises a ring-like resilient gasket of rectangular cross section elongated in a radial direction. The gasket is dimensioned to fit within the recess of the backshell. Thus, the shoulder and the recess cooperate with the gasket to provide environmental sealing with the frontshell threadably engaged to the backshell.

The backshell assembly disclosed in U.S. Pat. No. 4,707,047 provides effective environmental sealing and the extremely desirable attribute of universal applicability to a plurality of different frontshell configurations. However, it has been found that the gasket retaining recess disposed at a radial location between the shoulder and the external wall of the backshell and axially on both sides of the shoulder mating surface can be relatively expensive to machine. More particularly, the machining operation requires the formation of a generally radially outwardly extending annular recess in the wall of the backshell disposed in close proximity to an array of internal threads and extending axially on both sides of the shoulder. This recess has added to both the time and cost associated with the production of the backshell.

In view of the above, it is an object of the subject invention to provide a resilient seal between a backshell and frontshell that permits a relatively easily manufactured and inexpensive backshell construction.

It is a further object of the subject invention to provide an effective universal seal for environmentally sealing the interface between a frontshell and backshell.

It is an additional object of the subject invention to provide a backshell that effectively and securely retains a resilient seal without a recess extending radially outwardly from the shoulder and without extending axially on both sides of the shoulder.

Still another object of the subject invention is to provide enhanced sealing between a frontshell and backshell.

A further object of the subject invention is to provide an efficient molded elastomeric seal that can be securely retained in a backshell and that can be used with a plurality of different frontshell configurations.

SUMMARY OF THE INVENTION

The subject invention is directed to an environmental seal for use between two mateable components of an electrical connector assembly. In particular, the seal may be used for environmental sealing at the interface between a backshell and a frontshell. The seal may be formed from an elastomeric material unitarily molded to define a generally annular configuration.

The generally annular resilient seal is of irregular cross-sectional configuration, in contrast to the generally rectangular cross section of prior art seals used for this purpose. More particularly, the generally annular resilient seal comprises opposed inner and outer circumferential surfaces, a rearwardly facing mounting end and a forwardly facing mating end. The rearwardly facing mounting end is molded to define a rearward mounting means for engagement with a correspondingly configured mounting portion of a backshell. The mounting means of the seal may extend in an axial direction and may comprise a generally annular flange projecting rearwardly from a location on the seal intermediate the inner and outer circumferential surfaces thereof. The annular mounting flange may be generally rectangular in cross section, with its major axis extending generally parallel to the central axis of the seal.

The mounting end of the seal may further be defined by mounting faces on either side of the mounting means. The mounting faces may be molded to lie in a common plane which may extend generally perpendicular to the central axis of the seal. The configuration of the mounting end of the seal ensures positive yet easy mounting of the seal to the backshell, and further provides a seal/-backshell interface configuration that is difficult for moisture or environmental contaminants to bypass.

The forwardly facing mating end of the seal may be defined by means for securely retaining the seal in the backshell and deflectable means for sealing engagement with a frontshell. For example, the seal may comprise a pair of concentric forwardly facing annular projections. More particularly, the radially outermost portion of the mating end of the seal may define an annular locking ridge disposed and dimensioned to be engaged in a corresponding portion of the backshell. As explained in greater detail below, the locking ridge may be dimensioned to be engaged adjacent a generally cylindrical internal surface of the backshell disposed rearwardly from and adjacent to an array of internal threads.

The radially inner portion of the mating end may define a forwardly projecting deflectable annular sealing ridge. The sealing ridge may extend a greater distance in an axially forward direction than the locking ridge. Additionally, the radial thickness of the sealing ridge may be small compared to the total radial thickness of the seal. As a result, the sealing ridge is readily deflectable upon mating contact with the rearwardly facing end of a frontshell. The forwardmost end of the sealing ridge may be tapered to define either a forwardly facing convex surface or a forwardly facing concave surface. The orientation of this surface will in part determine the preferred direction of deflection of the sealing ridge upon contact with the rearwardly facing end of the frontshell. In many instances, it may be desirable to have the tapered forward end of the sealing ridge defining a convex generally frustoconical surface to urge the sealing ridge into a radially inward deflection upon contact with the frontshell.

The forwardly facing mating end of the seal may further define a forwardly facing annular groove between the locking and sealing ridges. The annular groove may be disposed at a location to receive the rearwardly facing end of at least certain frontshells with which the backshell may be mated. Thus, the rearwardly facing end of certain backshells may be engaged in the annular groove and between the resilient locking and sealing ridges of the seal. This entire forwardly facing mating end of the seal will deflect in accordance with the particular configuration of the rear end of the frontshell.

The backshell into which the seal is mounted comprises a forwardly facing mating end which is engageable with the rearwardly facing end of a frontshell. More particularly, the forwardly facing end of the backshell comprises an array of internal threads which is engageable with a corresponding array of external threads on the frontshell. The array of threads extends for a preselected distance from the extreme forward end of the backshell, and terminates at a generally internal cylindrical surface having a diameter approximately equal to the major diameter as measured between opposed ridges in the array of threads and also equal to the outer diameter of the seal. This internal cylindrical surface extends an axial distance rearwardly from the array of threads. The axial length of the internal cylindrical surface may approximately equal the axial length of the outer circumferential surface of the seal.

The forward end of the backshell further comprises a forwardly facing annular shoulder defining a diameter which is less than the minor diameter defined by ridges of the array of threads. In particular, the shoulder is disposed at an axial location spaced from the array of internal threads and defines the rearward extreme of the above described internal cylindrical surface. Thus, the internal cylindrical surface extends between the forwardly facing shoulder and the array of internal threads at the forward end of the backshell. The forwardly facing shoulder may define a plane which extends substantially perpendicular to the central axis of the backshell. The radial dimension of the forwardly facing annular shoulder in the backshell may approximately equal the radial thickness of the above described seal.

The annular shoulder in the forwardly facing end of the backshell may be characterized by mounting means engageable with the mounting means on the rearward mounting end of the seal. For example, the annular shoulder may be provided with an annular rearwardly directed groove formed therein. The annular groove may be generally coaxial with the longitudinal axis of the backshell. Furthermore, the annular groove may be dimensioned to frictionally retain the rearwardly projecting annular mounting flange of the seal. Thus, the radial dimensions of the annular groove may be selected to substantially conform to the radial dimensions of the mounting flange of the seal. More particularly, the annular groove may define major and minor diameters substantially equal to the major and minor diameters defined by the mounting flange of the seal. The major diameter defined by the annular groove and the annular mounting flange may be approximately equal to the minor diameter defined by the array of internal threads on the backshell. As a result of this construction, the mere rearward axial movement of the seal into the forwardly facing end of the backshell will align the mounting flange of the seal with the forwardly facing groove in the backshell. However, as noted above, the maximum diameter defined by the seal is approximately equal to the diameter of the internal cylindrical surface of the backshell, and therefore is greater than the minor diameter defined by the array of internal threads. Consequently, the locking ridge of the seal will resiliently deform as the seal is being inserted into the forwardly facing end of the backshell. However, upon sufficient insertion of the seal into the backshell, the locking ridge thereof will clear the minor diameter portion of the array of internal threads and will be engaged in the internal cylindrical surface between the internal array of threads and the forwardly facing shoulder.

These mounting structures for the seal on the forward end of the backshell can be readily machined yet ensure a secure resilient engagement of the seal. Conversely, the seal is molded to be easily retained in the backshell and provides improved environmental sealing at its interface with both the backshell and frontshell, as explained herein.

DETAILED DESCRIPTION OF THE PREFERRED EMBODIMENT

Figure 1:
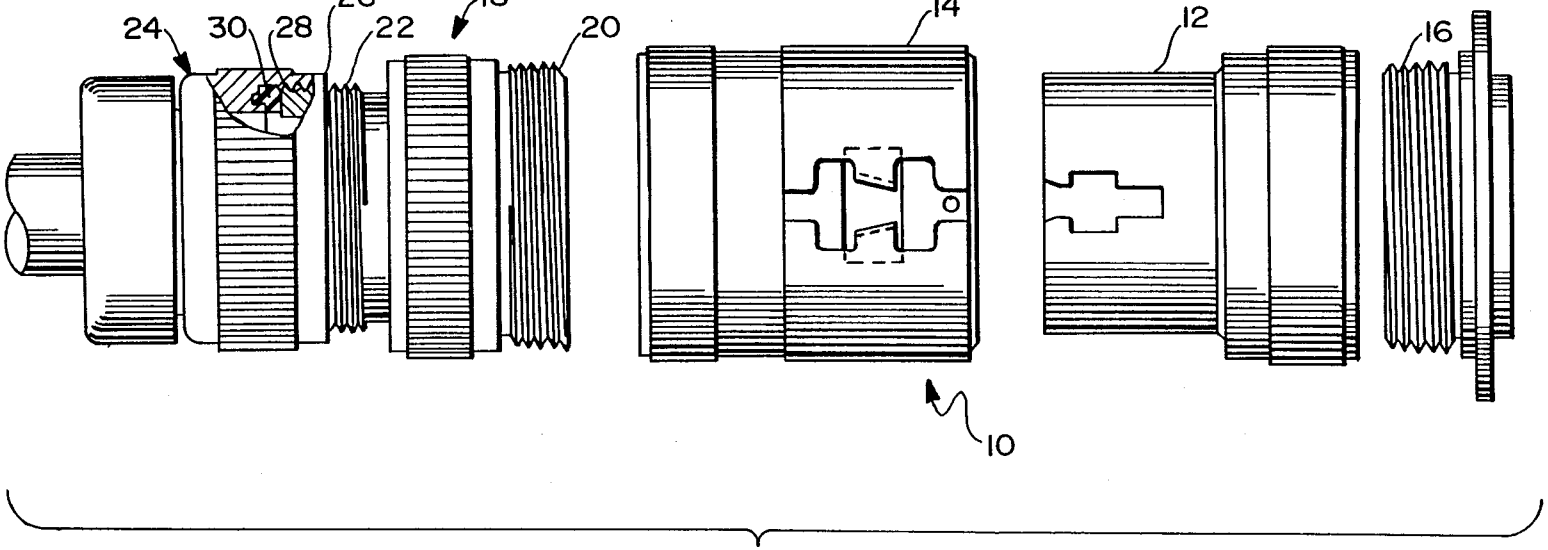
FIG. 1 is an exploded plan view, partly in section, showing the environmental seal of the subject invention incorporated into an electrical connector assembly.

FIG. 1 is provided to show a complete environmentally sealed connector assembly which incorporates the backshell and molded environmental seal of the subject invention. More particularly, the entire environmentally sealed connector assembly illustrated in FIG. 1 is identified generally by the numeral 10. The connector assembly 10 comprises a pair of mateable connectors 12 and 14. As depicted in FIG. 1, the connector 12 defines a plug which would be provided with at least one female electrical terminal mounted therein. The plug 12 is threadably engageable with a flange mounting 16 which in turn is mechanically mountable to a panel comprising a part of an electrical apparatus. The connector 14 defines a receptacle which is mateable with the plug connector 12. The receptacle connector 14 will be provided with at least one male terminal mounted therein which is mateable with corresponding female terminals mounted in the plug connector 12.

The environmentally sealed connector assembly 10 further comprises a front shell 18 having opposed forward and rearward externally threaded ends 20 and 22 respectively. The forward externally threaded end 20 of the frontshell 18 is threadably engageable with a corresponding array of internal threads (not shown) on the connector 14. The rearward array of external threads 22 is engageable with the backshell 24 of the subject invention. More particularly, the backshell 24 includes a forward end 26 having an array of internal threads 28 therein which are engageable with the externally threaded rearwardly projecting portion 22 of the backshell 18.

As noted above, the configuration of the connectors 12 and 14 can vary widely depending upon the intended use of the connectors 12 and 14 and the number of terminals therein. Similarly, the configuration of the frontshell 18 can vary depending upon the same parameters. These design parameters for the connectors 12 and 14 and for the frontshell 18 may result in a frontshell designed in accordance with a selected military specification. Based on the particular specification selected, the rearwardly projecting externally threaded end 22 of the frontshell 18 can have many different configurations. There must be effective environmental sealing between the frontshell 18 and backshell 24 for all such configurations of the frontshell 18. This environmental sealing is provided by the molded resilient seal 30 shown generally in its proper position on the connector assembly 10 of FIG. 1 and described in much greater detail below.

Figure 2:
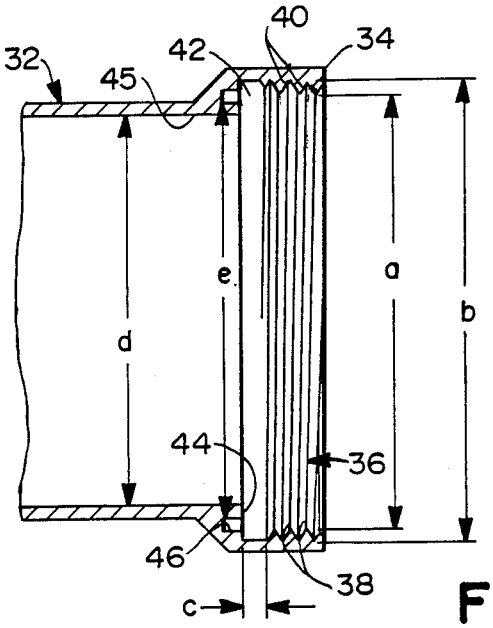
FIG. 2 is a cross-sectional view of the forward end of the backshell of the subject invention.

Another embodiment of a backshell in accordance with the subject invention is illustrated in FIG. 2 and is identified generally by the numeral 32. The backshell 32 comprises a forward end 34 which is mateable to a frontshell (not shown in FIG. 2). The forward end 34 of the backshell 32 is characterized by an array of internal threads 36 which are engageable with a corresponding array of external threads on a frontshell, such as the externally threaded end 22 of the frontshell 18 shown in FIG. 1, or the various frontshell configurations described and illustrated further below. The array of threads 36 is defined by alternating ridges 38 and grooves 40. The array of internal threads 36 defines a minor diameter "a" extending between opposed ridges 38, and a major diameter "b" extending between opposed grooves 40.

The backshell 32 is further defined by an internal cylindrical surface 42 disposed adjacent the internal array of threads 36 and rearwardly thereof. The internal cylindrical surface 42 is concentric with the array of threads 36 and defines a diameter substantially equal to the major diameter "b" of the array of threads 36. The internal cylindrical surface defines an axial length "c" as shown in FIG. 2.

The backshell 32 further comprises a forwardly facing annular shoulder 44 adjacent the extreme rearward end of the internal cylindrical surface 42, and generally orthogonal thereto. Stated differently, the internal cylindrical surface 42 extends between the array of threads 36 and the shoulder 44. The shoulder 44 terminates at internal cylindrical surface 45 which defines a minor diameter "d" which is less than the minor diameter "a" defined by the array of threads 36.

The shoulder 44 is characterized by a rearwardly extending annular groove 46 formed therein. The groove 46 is concentric with the axis of the backshell 32 and is generally rectangular in cross section. The major cross-sectional axis of the rectangular groove 46 is parallel to the axis of the backshell. The groove 46 defines a major diameter substantially equal to the minor diameter "a" defined by the array of internal threads 36. Thus, the outer circumferential surface of the groove 46 is substantially in line with the locus of points defined by the ridges 38 of the array of internal threads 36. The groove 46 further defines a minor diameter "e" which is less than the minor diameter "a" of the array of internal threads 36.

It will be appreciated by a person skilled in this art that both the internal cylindrical surface 42 and the annular groove 46 are disposed at locations in the backshell 32 that enable simplified machining or other such formation. It will further be appreciated that the internal cylindrical surface 42 and the annular groove 46 are disposed to easily accept the seal for achieving superior environmental sealing as explained below.

Figure 3:
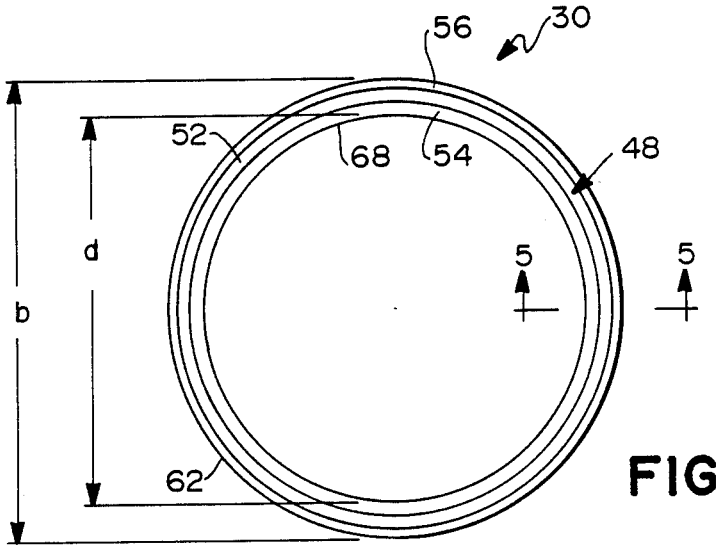
FIG. 3 is a top plan view of the seal of the subject invention.
Figure 4:
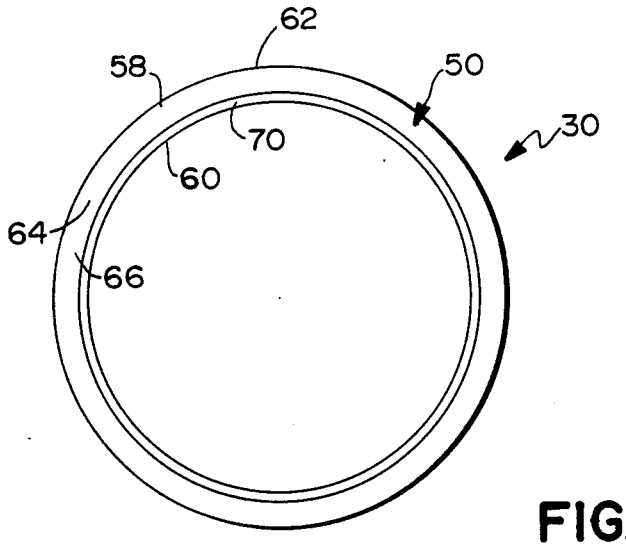
FIG. 4 is a bottom plan view of the seal.
Figure 5:
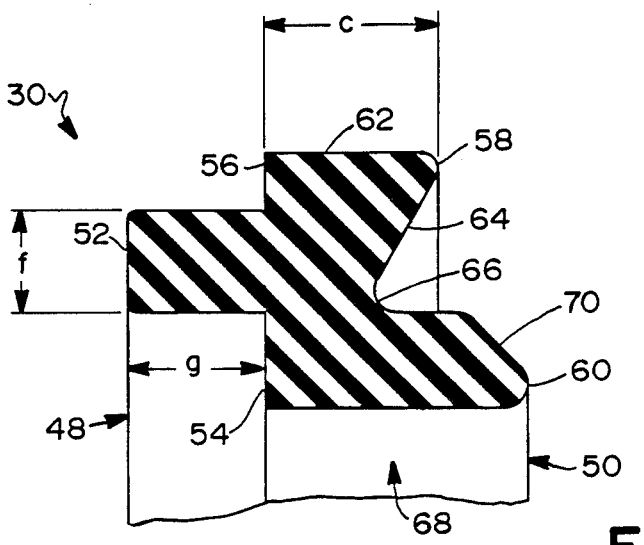
FIG. 5 is a cross-sectional view taken along line 5—5 in FIG. 3.

The seal 30 of the subject invention is illustrated most clearly in FIGS. 3–5. The seal 30 is molded from a unitary piece of resilient deflectable elastomeric material and defines a generally annular configuration. More particularly, the seal 30 defines an external diameter "b" substantially equal to the diameter of the internal cylindrical surface 42 of the backshell 32. The seal 30 further defines an internal diameter "d" substantially equal to the minor diameter of the shoulder 44 of the backshell 32.

The seal 30 comprises a mounting end 48 as shown in FIGS. 3 and 5, and a mating end 50 as shown in FIGS. 4 and 5. The mounting end 48, as shown most clearly in FIG. 5, is characterized by a rearwardly projecting annular mounting flange 52. More particularly, the rearwardly projecting mounting flange 52 defines an internal diameter substantially equal to the minor diameter "e" of the groove 46, and an external diameter substantially equal to the major diameter "a" of the groove 46. It follows that the radial thickness "f" of the rearwardly projecting mounting flange 52, as shown in FIG. 5, is approximately equal to the radial thickness of the mounting groove 46. Additionally, the axial length "g" of the rearwardly projecting mounting flange 52 is approximately equal to the axial depth of the groove 46 in the backshell 32.

The mounting end 48 of the seal 30 is further characterized by radially inner and radially outer mounting surfaces 54 and 56 respectively. More particularly, the radially inner and outer mounting surfaces 54 and 56 lie substantially in a common plane which extends substantially orthogonal to the central axis of the seal 30. The radially inner and outer mounting surfaces 54 and 56 are dimensioned to fit respectively on the portions of the shoulder 44 radially inwardly and outwardly from the groove 46 therein.

The mating end 50 of the seal 30 is characterized by a radially outwardly disposed forwardly projecting annular locking ridge 58 and a radially inwardly disposed forwardly projecting annular sealing ridge 60. More particularly, the locking ridge 58 is disposed adjacent the outer circumferential surface 62 of the seal 30 and is spaced from the mounting surface 56 by a distance "c" which is approximately equal to the longitudinal length of the internal cylindrical surface 42 of the backshell 32. The locking ridge 58 is further defined by an inwardly disposed surface 64 which is angularly aligned to the axis of the seal 30 to define a forwardly facing concave generally frustoconical configuration. The angular alignment of the surface 64 of seal 30 is helpful to urge the elastomeric material from which the resilient seal 30 is formed into tight sealing engagement with the internal surfaces of the backshell 32.

The angularly aligned surface 64 of the annular locking ridge 58 terminates at a base 66 defining a generally annular forwardly facing groove. The annular groove 66 is concentric with the axis of the seal 30 and is disposed to be radially inwardly from the array of threads 36 in the backshell 32 when the seal 30 is mounted in the backshell 32 as explained herein.

The annular sealing ridge 60 extends axially forward from the locking ridge 58 to define the forwardmost position of the seal 30 when mounted in the backshell 32. The sealing ridge 60 is disposed adjacent the internal circumferential surface 68 of the seal 30 which is disposed to be in line with the minor diameter portion of the shoulder 44 of the backshell 32. The sealing ridge 60 is defined by an outwardly disposed angularly aligned surface 70. More particularly, the surface 70 is angularly aligned to the axis of the seal 30 to define a forwardly projecting convex generally frustoconical surface. The angular alignment of the surface 70 will urge the sealing ridge 60 in a radially inward direction upon contact with a front shell, as explained further herein.

Figure 6:
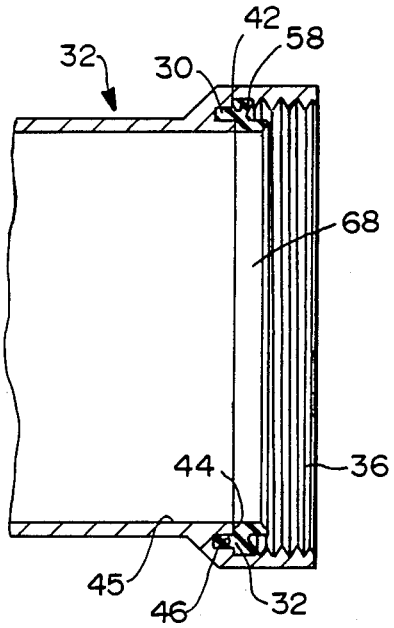
FIG. 6 is a cross-sectional view similar to FIG. 2 but showing the seal mounted in the backshell.
Figure 7:
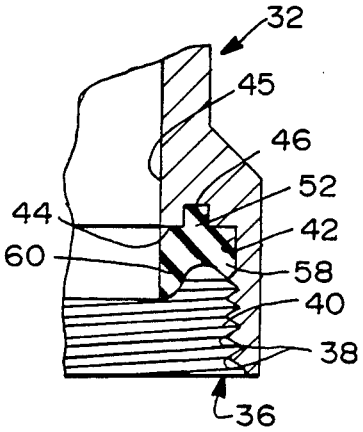
FIG. 7 is an enlarged cross-sectional view showing a portion of the seal mounted in the backshell.

The seal 30 is shown mounted in the backshell 32 in FIGS. 6 and 7. More particularly, the seal 30 is urged in an axially rearward direction relative to the backshell 32 such that the annular mounting flange 52 is urged into a frictionally secure engagement with the groove 46 in the backshell 32. In particular, the resilient material from which the seal 30 is formed ensures that the locking ridge 58 will deform to pass the array of internal threads 36 on the backshell 32. The locking ridge 58 will then be securely retained adjacent the array of threads 36 with the outer circumferential surface 62 of the seal 30 being disposed adjacent the internal cylindrical surface 42 of the backshell 32. Furthermore, the coplanar mounting surfaces 54 and 56 will be firmly seated against the shoulder 44 of the backshell 32 when the annular mounting flange 52 of the seal 30 is securely received in the annular groove 46 of the backshell 32. In this mounted condition, the inner circumferential surface 68 of the seal 30 will be generally in line with the minor diameter portion 45 of the backshell 32 adjacent to the shoulder 44. As shown most clearly in FIG. 7, in this fully mounted position of the seal 30 in the backshell 32, the annular sealing ridge 60 will extend forwardly into the portion defined by the array of threads 36 in the backshell 32.

Figure 9:
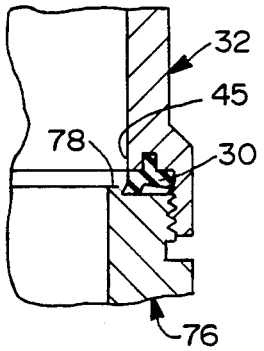
FIG. 9 shows the backshell and seal of the subject invention mated with a frontshell having a rearwardly projecting radially inwardly disposed flange.
Figure 8:
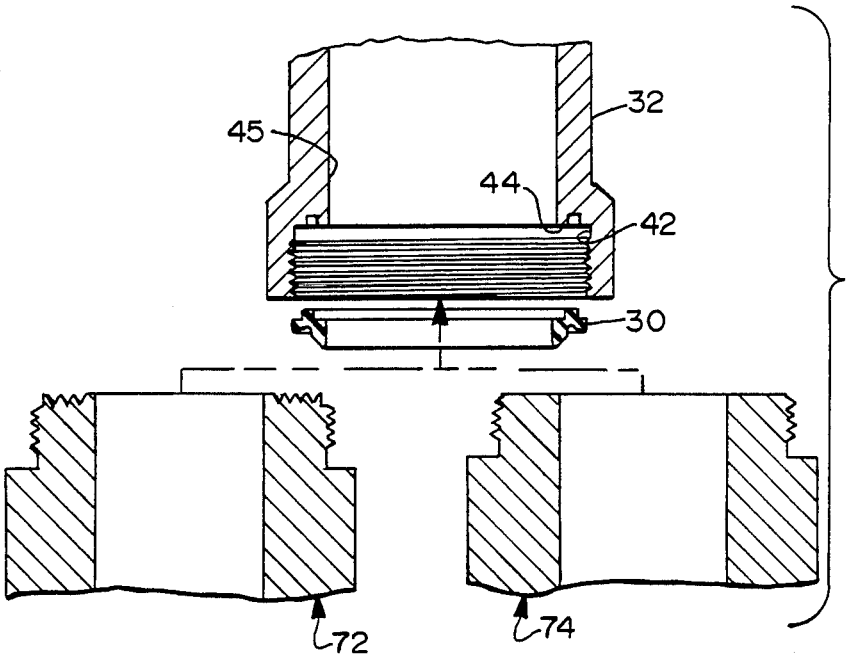
FIG. 8 is a cross-sectional view showing the backshell and seal of the subject invention which is mateable with a plurality of different frontshell configurations.

As illustrated schematically in FIG. 8, the combined seal 30 and backshell 32 can be used in conjunction with a plurality of different front shells 72, 74. In this regard, FIGS. 9–15 show the combined seal 30 and backshell 32 of the subject invention in mated condition with a plurality of different frontshells manufactured in accordance with military specifications. For example, as shown in FIG. 9, the combined seal 30 and backshell 32 are shown with a frontshell 76 having a radially thick peripheral wall and having a radially inwardly disposed flange 78. The flange 78 of the frontshell 76 is disposed to be positioned inwardly from the internal surface 45 of the backshell 32. As the frontshell 76 is threadably engaged with the backshell 32, the rearwardmost surface 80 of the frontshell 76 will engage the sealing ridge 60 to achieve an environmentally sealed engagement. The threaded engagement of the frontshell 76 with the backshell 32 urges the sealing ridge 60 in a radially inward direction into tighter sealing engagement with the radially inwardly disposed flange 78 of the frontshell 76. This inward deflection of the sealing ridge 60 of seal 30 will be ensured by the angular alignment of surface 70 on the seal 30, as shown most clearly in FIG. 5 above.

Figure 10:
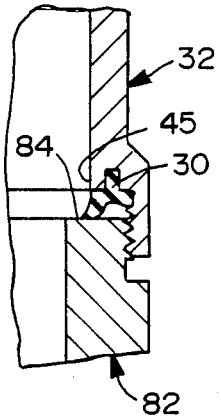
FIG. 10 is a cross-sectional view showing the backshell and seal of the subject invention mated with a frontshell having a thick wall and a planar rearwardly facing surface.

FIG. 10 shows a frontshell 82 having a radially thick peripheral wall similar to the frontshell 76 depicted in FIG. 9. However, the forwardly facing surface 84 of the frontshell 82 is not characterized by a flange comparable to the flange 78 depicted in FIG. 9. In this embodiment, the planar forward surface 84 of the frontshell 82 will engage the sealing ridge 60 for tight environmental sealing. As noted above, the threaded engagement of the frontshell 82 into the backshell 32 will urge the sealing ridge 60 in a radially inward direction by virtue of the convex surface 70 extending from the forward end of the sealing ridge 60.

Figure 11:
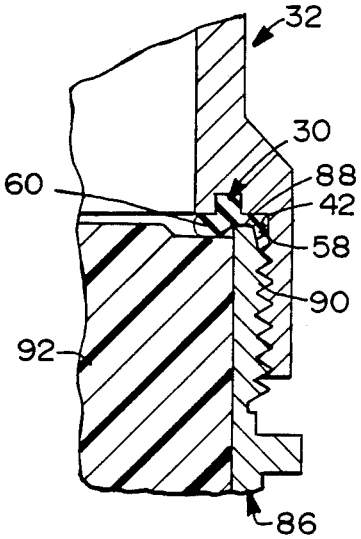
FIG. 11 is a cross-sectional view showing the backshell and seal of the subject invention mated with a frontshell having a thin peripheral wall and a nonmetallic support centrally disposed therein.

FIG. 11 shows a frontshell 86 having a radially thin peripheral wall with a planar mating surface 88. It will be noted that the mating surface 88 extends rearwardly beyond the external threads 90 of the frontshell 86. The frontshell 86 is further provided with a nonmetallic insulating material 92 disposed therein and axially generally in line with the mating surface 88 of the frontshell 86. As shown in FIG. 11, the threaded engagement of the frontshell 86 into the backshell 32 will cause the mating end 88 of the frontshell 86 to engage the concave surface 64 of the locking ridge 58, while the nonmetallic insulating material 92 will engage the sealing ridge 60. Complete threaded engagement as shown in FIG. 11 causes the mating end 88 to urge the locking ridge rearwardly and radially outwardly into tight environmentally sealing engagement with the backshell 32. Similarly, the engagement between the nonmetallic insulating material 92 and the sealing ridge 60 will deflect the sealing ridge 60 in a radially inward direction to further enhance the environmental sealing.

Figure 12:
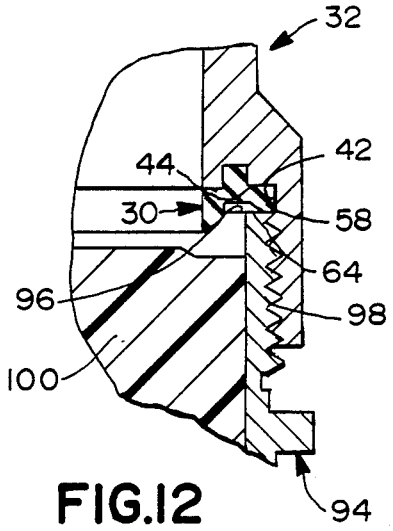
FIG. 12 is a cross-sectional view of the backshell and seal of the subject invention mated with a frontshell similar to that shown in FIG. 11 but with the nonmetallic insulating material disposed at a different axial location therein.

FIG. 12 shows a frontshell 94 having a radially thin peripheral wall and having a mating surface 96 disposed substantially in line with the rearward end of the threads 98 on the frontshell 94. A nonmetallic insulating material 100 is disposed within the frontshell 94 but terminates forwardly from the mating surface 96. In this embodiment, the mating end 96 of the frontshell 94 will contact only the locking ridge 58 of the seal 30. However, this contact will urge the locking ridge into tight environmentally sealed engagement with both the interior cylindrical surface 42 and the shoulder 44 of the backshell 32.

Figure 13:
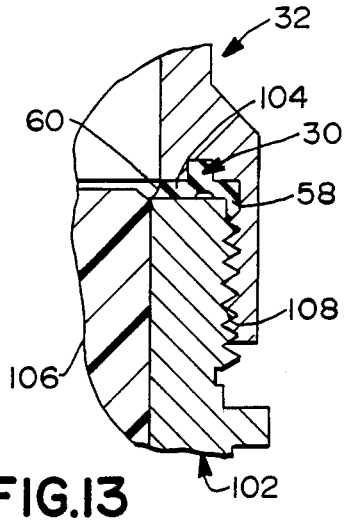
FIG. 13 is a cross-sectional view of the backshell and seal of the subject invention mated with a frontshell having a thick peripheral wall and a nonmetallic insulating material disposed centrally therein.

FIG. 13 shows a frontshell 102 having a radially thick peripheral wall and a planar mating end 104. A nometallic insulating material 106 is disposed within the frontshell 102. The mating end 104 of the frontshell 102 extends rearwardly beyond the array of threads 108 thereof. As shown clearly in FIG. 13, both the locking ridge 58 and the sealing ridge 60 will be substantially resiliently deformed by the mating end 104 of the frontshell 102.

Figure 14:
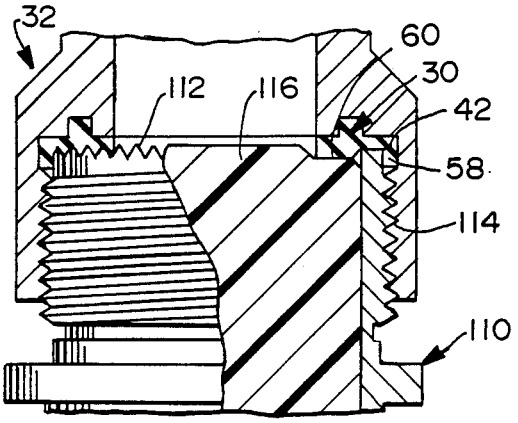
FIG. 14 is a cross-sectional view showing the backshell and seal of the subject invention mated with a frontshell having a serrated rearwardly facing surface and a nonmetallic insulating material mounted centrally therein.
Figure 15:
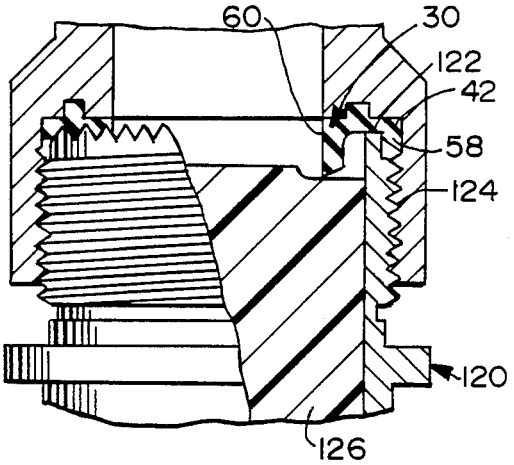
FIG. 15 is a cross-sectional view similar to FIG. 14, but showing the nonmetallic insulating material at a different axial location therein.

FIGS. 14 and 15 show the seal 30 and backshell 32 used with frontshells having serrated mating ends. In particular, the frontshell 110 in FIG. 14 includes a serrated mating end 112 which extends axially rearwardly from the array of threads 114 on the frontshell 110. A nonmetallic insulating material 116 is disposed centrally therein and at an axial location approximately in line with the serrated mating end 112. As shown in FIG. 14, the serrated mating end 112 of the frontshell 110 will deform the annular locking ridge 58 into tight environmental sealing engagement with the backshell 32. The insulating material 116 will engage and resiliently deform the annular sealing ridge 60. In the embodiment shown in FIG. 15, a frontshell 120 is provided with a mating end 122 disposed axially rearwardly from the threads 124 of the frontshell 120. A nonmetallic insulating material 126 is disposed within the frontshell 120 but at an axially forward position from the rearward mating end 122 of the frontshell 120. In this embodiment, the insulating material 126 will not significantly deform the locking ridge 60 of the seal 30. However, the serrated mating end 122 will contact and resiliently deform the annular locking ridge 58 into secure environmental sealing engagement with the backshell 32.

In summary, an environmental seal and backshell are provided for secure environmental sealing engagement with a plurality of different frontshell configurations. The backshell includes an array of internal threads for mating with the external threads of a frontshell. An internal cylindrical surface is provided rearwardly of the threads of the backshell and defines a diameter substantially equal to the major diameter of the threads. A shoulder extends inwardly from the internal cylindrical surface and includes a rearwardly projecting groove therein. The seal is dimensioned to fit within the internal cylindrical surface of the backshell. The seal includes an annular mounting flange to engage the groove in the backshell shoulder and includes forwardly projecting annular locking and sealing ridges.

We claim:

1. An electrical connector backshell for environmentally sealed mounting to any of a plurality of different cylindrical frontshells, said backshell being of generally cylindrical configuration having opposed forward and rearward ends, said backshell comprising:

an array of internal threads adjacent the forward end thereof for mounting to said frontshell, said array of internal thread extending from said forward end to a location intermediate said forward and rearward ends, said array of internal threads having a major diameter and a minor diameter;

an interior cylindrical surface adjacent said array of internal threads and extending axially to a location intermediate said array of internal threads and the rearward end of said backshell, said interior cylindrical surface having a diameter substantially equal to the major diameter defined by said array of internal threads;

a generally annular mounting shoulder adjacent the rearward end of said interior cylindrical surface and extending radially inwardly therefrom, said shoulder being characterized by a rearwardly extending annular groove intermediate the radially innermost portion of said shoulder and the interior cylindrical surface of said backshell; and a generally annular resilient seal having an outer diameter substantially equal to the diameter defined by the interior cylindrical surface of said backshell and an outer circumferential surface having an axial length substantially equal to the axial length of said interior cylindrical surface of the backshell, said seal further comprising a rearward mounting end and a forward mating end, said rearward end including a rearwardly projecting annular mounting flange, said seal being disposed that the annular mounting flange is engaged in the annular groove formed in the mounting shoulder, the outer circumferential surface of the seal being disposed adjacent the interior cylindrical surface of said backshell, the forward mating end of said seal being defined by an annular locking ridge disposed along a radially outermost portion of the mating end of the seal for engagement adjacent the rearwardmost portion of said array of internal threads, said annular locking ridge including a radially inner portion defining a generally concave frustoconical surface, said forward mating end of the seal being further defined by a radially inwardly disposed forwardly projecting annular deflectable sealing ridge, said annular sealing ridge of said seal including a radially outwardly disposed inclined surface oriented to the central axis of the backshell assembly to define a forwardly projecting convex frustoconical surface, whereby, upon mounting of said backshell assembly to said frontshell, the sealing ridge is urged into a radially inward deflection to form a tight environmentally sealed engagement between any of a plurality of frontshells and the mounting shoulder and the locking ridge is urged radially outwardly into environmentally sealing engagement with said interior cylindrical surface and annular mounting shoulder, respectively.

* * * * *